United States Patent [19]

Moore et al.

[11] 4,095,502

[45] Jun. 20, 1978

[54] SOUND CONTROL SYSTEM IN AN ELECTRONIC MUSICAL INSTRUMENT

[75] Inventors: William T. Moore, Mansfield, Tex.; Tadayaki Adachi, Hamamatsu, Japan

[73] Assignee: Rhythm Band, Inc., Fort Worth, Tex.

[21] Appl. No.: 688,824

[22] Filed: May 21, 1976

[51] Int. Cl.[2] ..... G10H 3/00

[52] U.S. Cl. ..... 84/1.13; 84/1.26; 84/1.07; 84/1.27; 84/1.12

[58] Field of Search ..... 84/1.07, 1.08, 1.09, 84/1.1, 1.12, 1.13, 1.21, 1.26, 1.27

[56] References Cited

U.S. PATENT DOCUMENTS

| | | | |
|---|---|---|---|
| 2,492,320 | 12/1949 | Riggen | 84/1.27 X |
| 3,516,321 | 6/1970 | Harris | 84/1.27 X |
| 3,526,702 | 9/1970 | Freeman | 84/1.09 X |
| 3,602,628 | 8/1971 | Peterson | 84/1.27 X |
| 3,784,718 | 1/1974 | Uchiyama | 84/1.26 X |
| 3,816,636 | 6/1974 | Peltz | 84/1.27 X |

*Primary Examiner*—Ulysses Weldon
*Attorney, Agent, or Firm*—Wofford, Felsman, Fails & Zobal

[57] ABSTRACT

In an electronic musical instrument of the type having keys, a system for controlling the volume of the sound produced by the instrument when the keys are depressed or struck. For each key, the system comprises a tone generator, a gate coupled between the tone generator and the speaker of the instrument; and control means for producing a control signal having an amplitude which is a function of the speed at which its associated key is moved while being depressed. The control signal is applied to the gate to pass the output of the tone generator to the speaker and to control the volume of the sound produced by the speaker.

2 Claims, 6 Drawing Figures

SOUND CONTROL SYSTEM IN AN ELECTRONIC MUSICAL INSTRUMENT

SUMMARY OF THE INVENTION

It is an object of the present invention to provide a system for controlling the volume of the sound produced by an electronic musical instrument of the type having a plurality of movable keys. The operation of the system for controlling the volume of the sound is based upon the speed at which the keys are moved when they are struck or depressed.

For each key, the system comprises signal generating means for generating at its output a distinctive frequency signal; normally closed gate means having an input coupled to the output of the signal generating means and an output coupled to the speaker of the musical instrument; control means responsive to the speed to which the key is moved while being depressed for producing a control signal having an amplitude which is a function of speed of movement of the key; and means for applying the control signal to the input of the gate means for actuating the gate means for passing the output of the signal generating means to the speaker and for controlling the sound level of the speaker.

In the embodiment disclosed, the control means comprises a first capacitor for storing a predetermined amount of charge; a second capacitor coupled to the input of said gate means; and a switching system movable by the key for applying a quantity of charge from the first capacitor to the second capacitor dependent upon the speed at which the switching system is moved by the key when it is depressed. The charge applied to the second capacitor forms the control signal for actuating the gate means.

DETAILED DESCRIPTION OF THE INVENTION

Figure 1:
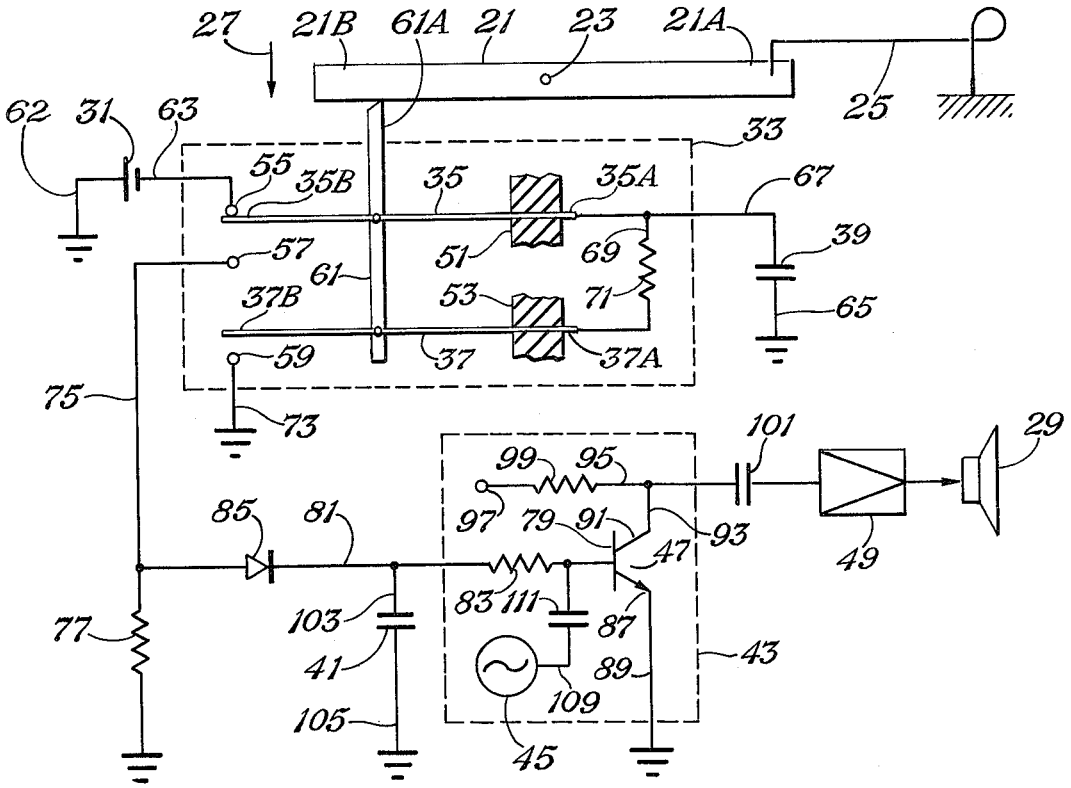
FIG. 1 is a schematic of the control system for a given key of an electronic piano employing contacts movable by the key when it is depressed for operating the system.

Referring now to FIG. 1, there is illustrated a key 21 of an electronic piano. The key is supported for pivotal movement by a pin 23 and has a spring 25 connected to its rear end 21A for normally maintaining the key in the position shown. The front end 21B of the key may be depressed in the direction of the arrow 27 to actuate a speaker 29 to produce a distinctive sound tone associated with the key. When the key is released, the spring 25 returns the key to its normal position. Although not shown, the piano has a plurality of other keys which may be depressed to actuate the speaker to produce different tones. The speaker 29 is common to all of the keys.

A sound control system is associated with each key to control the volume of the sound produced by the speaker depending upon the intensity in which the key is struck or depressed. Basically, the sound control system comprises a DC source of voltage 31, a switching system 33 comprising two contacts 35 and 37 movable by the key 21; a first capacitor 39; a second capacitor 41; and a gate system 43 including an oscillator or tone generator 45 coupled to a normally closed gate 47 the output of which is coupled to the speaker 29 by way of amplification and filter stages 49.

Figures 2A, 2B, 2C, 2D:
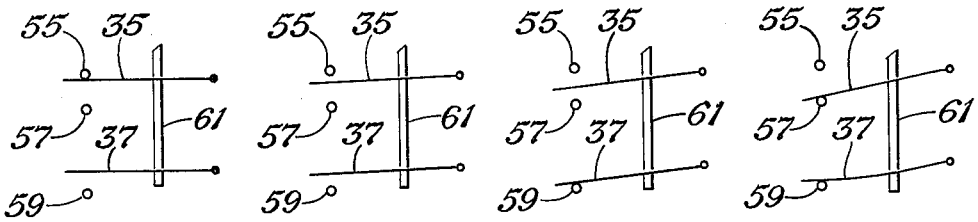
FIG. 2A illustrates the relationship of the movable contacts with stationary contacts when the movable contacts are in their normal positions.
FIG. 2B–2D illustrate the changing positions of the movable contacts relative to the stationary contacts as the key is struck or depressed.

The contacts 35 and 37 are thin flexible spring members having ends 35A and 37A fixed in place and opposite ends 35B and 37B which are free to move. Ends 35A and 37A are secured in fixed positions to insulating supports 51 and 53 respectively. Located on opposite sides of the end 35A of contact 35 are two stationary contacts 55 and 57. A stationary contact 59 also is located on the lower side of the end 37B of contact 37 as shown in FIG. 1. Secured to contacts 35 and 37 intermediate their ends is an insulating rod 61 having an end 61A for engaging the lower side of key 21. When the key is depressed, it moves the rod 61 downward which in turn moves the two contacts 35 and 37 downward. When the key 21 is in its normal position, the contacts 35 and 37 are in the positions shown in FIG. 2A wherein contact 35 engages stationary contact 55 and is out of engagement with stationary contact 57 and contact 37 is out of engagement with stationary contact 59. When the key is depressed, contacts 35 and 37 are moved downward by the rod 61 to engage stationary contacts 57 and 59 respectively. Stationary contacts 57 and 59 are located such that when the movable contacts 35 and 37 are in the normal position as shown in FIGS. 1 and 2A, the distance between movable contact 37 and stationary contact 59 is less than the distance between movable contact 35 and stationary contact 57. Thus, when the key 21 is depressed, contact 37 engages stationary contact 59 before contact 35 engages stationary contact 57. This can be seen by reference 2B-2D. In FIG. 2B the key has just been depressed and movable contact 35 has been moved away from contact 55 and has not yet engaged contact 57. In addition movable contact 37 has not yet engaged contact 59. In FIG. 2, the key has been depressed further whereby contact 37 engages contact 59, however, contact 35 has not yet engaged contact 57. In FIG. 2D, the key has been depressed fully whereby contact 35 engages contact 57 and contact 37 engages contact 59.

DC source 31 has one side grounded by way of conductor 62 and the other side connected to contact 55 by way of a conductor 63. Capacitor 39 has one side grounded by way of conductor 65 and its other side connected to contacts 35 and 37 by way of conductors 67 and 69, the latter of which includes a resistor 71. Contact 59 is grounded by way of conductor 73 while contact 57 is grounded by way of a conductor 75 and a resistor 77.

The gate 47 comprises a transistor having its base 79 connected to conductor 75 by way of a conductor 81 which includes a resistor 83 and a diode 85. The emitter 87 of the transistor is grounded by way of conductor 89 and the collector 91 is connected by way of a conductor 93 to a conductor 95, the latter of which is connected to a DC voltage bar 97 by way of a resistor 99. Although not shown, a DC voltage source is connected to bar 97. Conductor 95 also is connected to the amplifier 49 by way of a capacitor 101. The transistor gate 47 is normally biased such that it is in off condition. It may be rendered conductive by the application of a bias voltage to its base 79. The amount of bias voltage applied to the base affects the amount of conduction of the transistor.

Capacitor 41 has one side connected to conductor 81 by way of a conductor 103 and its other side ground by way of a conductor 105. The capacity of capacitor 41 is much smaller than that of capacitor 39. The output of the oscillator 45 is connected to conductor 81 between resistor 83 and the base 79 of the transistor. Connection is by way of a conductor 109 which includes a capacitor 111.

Figure 3:
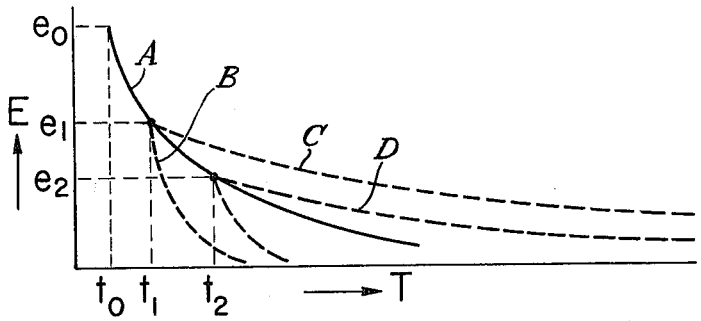
FIG. 3 are curves useful in understanding the operation of the sound control system.

When the key 21 is in its normal position and hence when the contacts 35 and 37 are in their normal positions, the capacitor 39 is charged to a predetermined voltage level from source 31 by way of conductor 63, contact 55, contact 35 and conductor 67. The level of this voltage is illustrated by $e_o$ in FIG. 3. When the key is struck or depressed and the contacts 35 and 37 reach the position shown in FIG. 2C wherein contact 37 engages contact 59 and contact 35 is out of engagement with contacts 55 and 57, capacitor 39 begins to discharge to ground by way of conductors 67 and 69, resistor 71, contact 37, contact 59 and conductor 73. In FIG. 3, curve A illustrates the complete discharge of capacitor 39 to ground which would occur through contact 37 if the contacts 35 and 37 was maintained in the position shown in FIG. 2C. Time $t_o$ is the time at which contact 37 first engages contact 59 during movement of the contacts 35 and 37 to the position shown in FIG. 2C.

When the contacts 35 and 37 reach the position shown in FIG. 2D wherein contact 35 engages contact 57, capacitor 39 also begins to discharge to ground by way of contact 35, contact 55, conductor 75 and resistor 77. Curve B in FIG. 3 illustrates the discharge of capacitor 39 to ground through both of contacts 35 and 37 when the contacts are in the position of FIG. 2D. Time $t_1$ is the time at which contact 35 first engages contact 57 during movement of the contacts 35 and 37 to the position shown in FIG. 2D. At time $t_1$ when contact 35 first engages contact 57, the voltage or charge on capacitor is at the level of $e_1$ and this voltage also is applied to charge capacitor 41 by way of conductor 81 and diode 85. Since the capacity of capacitor 41 is much smaller than that of capacitor 39, capacitor 41 will be charged to almost the same level as the voltage at $e_1$ when contact 35 first engages contact 57 at $t_1$. Diode 85 prevents capacitor 41 from discharging through resistor 77, however, capacitor 41 does discharge through resistor 83 to provide bias voltage to the base 79 of the transistor 47 to cause the transistor to conduct. In FIG. 3 the discharge of capacitor 41 through resistor 83 is illustrated by curve C. When transistor 47 conducts, the frequency signal from oscillator 45 is in effect passed through the transistor 47 to amplifier 49 and then to speaker 29 for producing a sound tone dependent upon the frequency produced by the oscillator 45. The volume of the sound produced by the speaker 29 is dependent upon the level of the voltage applied from the capacitor 41 as bias voltage to the base of the transistor 47. The larger this voltage, the greater the volume of the sound produced by the speaker. The amount of voltage applied from the capacitor 41 as bias voltage to the transistor depends upon the amount of voltage transferred from capacitor 39 to capacitor 41 as the key 21 struck or depressed. The voltage transferred to capacitor 39 is dependent upon the time between $t_o$ and $t_1$ which in turn is dependent upon the speed at which the key is moved as it is struck or depressed. If the key is struck with great intensity, it will move rapidly thereby moving contacts 35 and 37 rapidly whereby the time between $t_o$ and $t_1$ will be short. Thus, a relatively large amount of voltage ($e_1$) will be discharged from capacitor 39 to capacitor 41 whereby the volume of the sound produced by speaker 29 will be relatively high. If the key is struck softly, it will move at a slower rate thereby moving contacts 35 and 37 at a slower rate. Thus, the time between $t_o$ and $t_1$ will be greater whereby the voltage discharged from capacitor 39 to capacitor 41 will be less. For example, referring to FIG. 3, if contact 35 engages contact 57 at time $t_2$ relative to $t_o$, the voltage level of capacitor 39 at that time will be $e_2$. This lower voltage thus will be transferred to capacitor 41 whereby the volume of the sound produced by speaker 29 will be at a lower level.

In the system described in FIG. 1, the DC voltage source 31 is common to the sound control system of each key as well as the DC voltage source connected to DC voltage bar 97. Although not shown, an on-off switch is employed to disconnect the source 31 from the system and the DC voltage source from the bar 97 and to render each oscillator 45 inactive when the piano is not in use. When the switch is moved to the on position, the source 31 will be connected as shown, the DC voltage source will be connected to bar 97 and each of the oscillators 45 will be actuated.

Although the sound control system of the present invention was described in connection with an electronic piano, it will be understood that it may be employed in other types of electronic musical instruments having keys.

We claim:

1. In an electronic musical instrument having a plurality of movable keys for controlling the sound produced by a speaker, a sound control system for each key, comprising:

signal generating means for generating a distinctive frequency signal, gate means having an input coupled to said signal generating means and an output coupled to said speaker, first and second movable contacts, first and second stationary contacts to be engaged by said first movable contacts, a third stationary contact to be engaged by said second movable contact, said first movable contact being supported to engage said first stationary contact and to be out of engagement with said second stationary contact when said key is in its normal position, said second movable contact being supported to be out of engagement with said third stationary contact when said key is in its normal position, means adapted to be engaged by said key for moving said first and second movable contacts to engage said second and third stationary contacts respectively when said key is depressed, said first movable contact being disengaged from said first stationary contact when said key is depressed, said second and third stationary contacts being located such that said second movable contact engages said third stationary contact before said first movable contact engages said second stationary contact when said key is depressed, first capacitor means electrically connected to said first and second movable contacts, a source of voltage connected to said first stationary contact for charging said first capacitor means through said first movable contact when it engages said first stationary contact, means for connecting said third stationary contact to ground to allow said first capacitor means to begin to discharge when said second movable contact engages said third stationary contact, circuit means connecting said second stationary contact with said input of said gate means, ground means connected to said circuit means and to ground to allow said first capacitor means to discharge through said ground means when said first movable contact engages said second stationary contact, and second capacitor means connected to said circuit means between the connection of said ground means with said circuit means and said input of said gate means for receiving a quantity of charge from said first capacitor means dependent upon the time between engagement of said second movable contact means with said third stationary contact means and said first movable contact means with said second stationary contact means when said key is depressed, said quantity of charge received by said second capacitor means being applied to said gate means for passing the output from said signal generating means to said speaker and for controlling the sound level of said speaker.

2. The sound control system of claim 1 wherein: the capacity of said second capacitor means is much less than the capacity of said first capacitor means.

* * * * *